US005775278A

United States Patent [19]

Moriya et al.

[11] Patent Number: 5,775,278

[45] Date of Patent: Jul. 7, 1998

[54] ENERGIZATION CONTROL METHOD, AND ELECTROMAGNETIC CONTROL SYSTEM IN ELECTROMAGNETIC DRIVING DEVICE

[75] Inventors: Takashi Moriya; Yasuyuki Komatsu; Hiroshi Sono; Takashi Sugai, all of Saitama, Japan

[73] Assignee: Honda Giken Kogyo Kabushiki Kaisha, Tokyo, Japan

[21] Appl. No.: 787,707

[22] Filed: Jan. 24, 1997

Related U.S. Application Data

[62] Division of Ser. No. 485,705, Jun. 7, 1995, Pat. No. 5,636,601.

[30] Foreign Application Priority Data

| | | | |
|---|---|---|---|
| Jun. 15, 1994 | [JP] | Japan | 6-133423 |
| Jun. 15, 1994 | [JP] | Japan | 6-133425 |
| Jul. 8, 1994 | [JP] | Japan | 6-157106 |

[51] Int. Cl.[6] ..... F01L 9/04

[52] U.S. Cl. ..... 123/90.11; 251/129.01; 251/129.1

[58] Field of Search ..... 123/90.11; 251/129.01, 251/129.1

[56] References Cited

U.S. PATENT DOCUMENTS

| | | | |
|---|---|---|---|
| 4,544,986 | 10/1985 | Buchi | 123/90.11 |
| 4,823,825 | 4/1989 | Buchl | 123/90.11 |
| 4,846,120 | 7/1989 | Buchl | 123/90.11 |
| 5,080,323 | 1/1992 | Kreuter | 251/129.1 |
| 5,125,370 | 6/1992 | Kawamura | 123/90.11 |
| 5,222,714 | 6/1993 | Morinigo et al. | 251/90.11 |
| 5,548,263 | 8/1996 | Bulgatz et al. | 335/256 |

FOREIGN PATENT DOCUMENTS

| | | |
|---|---|---|
| 57-44716 | 3/1982 | Japan . |
| 59-213913 | 12/1984 | Japan . |

*Primary Examiner*—Weilun Lo
*Attorney, Agent, or Firm*—Lyon & Lyon LLP

[57] ABSTRACT

An electromagnetic driving device includes an armature, a pair of electromagnets disposed in an opposed relation to each other on opposite sides of the armature so as to be able to apply an electromagnetic attracting force to the armature, and a pair of return springs for biasing the armature toward the electromagnets, respectively. In the electromagnetic driving device, the energizing quantity for the electromagnets is varied in accordance with operational conditions. Thus, it is possible to insure the attracting and maintaining of the armature to and on the electromagnets irrespective of changes in operational conditions. In addition, the energizing quantity for the electromagnets is varied in accordance with the distance between the armature and the electromagnets. Thus, it is possible to avoid a wasteful consumption of electric power in the electromagnets to enable a reliable attracting and maintaining of the armature.

10 Claims, 13 Drawing Sheets

ENERGIZATION CONTROL METHOD, AND ELECTROMAGNETIC CONTROL SYSTEM IN ELECTROMAGNETIC DRIVING DEVICE

This is a Division of U.S. Ser. No. 08/485,705, filed Jun. 7, 1995, now U.S. Pat. No. 5,636,601, issued on Jun. 10, 1997.

BACKGROUND OF THE INVENTION

1. Field of the Invention

The present invention relates to an energization control method and an electromagnetic control system for an electromagnetic driving device including an armature, a pair of electromagnets disposed in an opposed relation to each other on opposite sides of the armature so as to be able to apply an electromagnetic attracting force to the armature, and a pair of return springs for biasing the armature toward the electromagnets. The present invention further relates to an electromagnetic driving device for an engine valve in an internal combustion engine in which an engine valve is operatively connected to an armature.

2. Description of the Prior Art

There is an electromagnetic driving device conventionally well-known, for example, from U.S. Pat. No. 5,222,714, which includes an armature, a pair of electromagnets disposed in an opposed relation to each other on opposite sides of the armature so as to be able to apply an electromagnetic attracting force to the armature, and a pair of return springs for biasing the armature toward the electromagnets, respectively. There is also an electromagnetic driving device conventionally known, for example, from Japanese Patent Application Laid-open No. 44716/82, which includes an armature, a pair of electromagnets disposed in an opposed relation to each other on opposite sides of the armature so as to be able to exhibit an electromagnetic force for attracting the armature, a pair of return springs for biasing the armature toward the electromagnets, respectively, and an equilibrium position changing means for changing the equilibrium neutral position of the armature maintained by both the return springs in deexcited states of the electromagnets between a first position which is substantially halfway between both the electromagnets and a second position in which the armature is in proximity to one of the electromagnets. Further, there is an electromagnetic driving device for an engine valve in an internal combustion engine known, for example, from Japanese Patent Application Laid-open No. 213913/84, which includes an armature operatively connected to the engine valve, a valve-closing electromagnet for exhibiting an electromagnetic force for attracting the armature to close the engine valve, a valve-opening electromagnet for exhibiting an electromagnetic force for attracting the armature to open the engine valve, a valve-closing return spring for biasing the armature in a direction to close the engine valve, and a valve-opening return spring for biasing the armature in a direction to open the engine valve.

In the electromagnetic driving device disclosed in U.S. Pat. No. 5,222,714, the energization of the electromagnets is controlled with a given energization amount. However, the attracting electromagnetic forces exhibited by the electromagnets, if the electromagnets are energized with the same energization amount, are decreased in accordance with an increase in temperature, and therefore, with an increase in temperature, the attracting and maintaining of the armature by the electromagnets are liable to fail. When the inertial force of the armature is increased with an increase in the number of operations per unit of time, the attracting and maintaining of the armature by the electromagnets are liable to fail, if they exhibit the same attracting electromagnetic force.

In the electromagnetic driving device disclosed in Japanese Patent Application Laid-open No. 44716/82, the armature is connected to an engine valve as an intake valve or an exhaust valve, and the equilibrium position changing means is provided to forcibly move the engine valve to a closed position at the start of an engine. During operation of the engine, the equilibrium position changing means shifts the equilibrium neutral position of the armature to a position which is substantially halfway between both the electromagnets. However, if the attraction of the armature by one of the electromagnets which attracts the armature in a valve closing direction becomes incomplete during operation of the engine, the engine valve starts an opening lifting before being closed under the action of the spring forces of return springs, and starts to be closed before reaching a maximum lifted position, and the armature starts a free vibration without being maintained on any of electromagnets. Such a free vibration is likewise produced even when the movement of the armature toward the electromagnet which exhibits the attracting electromagnetic force in a valve-opening direction becomes incomplete. If the vibration is produced in this manner, there is a possibility that interference of the piston and engine valve with each other may be produced depending upon the position of the piston, and interference of the intake and exhaust valves with each other is also produced and as a result, a different sound may be generated and a defective deformation and operation of the piston and engine valve may be produced.

Further, in the electromagnetic driving device for the engine valve in the internal combustion engine disclosed in Japanese Patent Application Laid-open No. 213913/84, an operating force for operating the engine valve in a closing direction and an operating force for operating the engine valve in an opening direction are set equally. However, when the engine valve fails to operate in the opening direction, only a reduction in engine output is produced, and it is possible to continue the operation of the engine, and there is less influence on the operation of the engine. On the other hand, when the engine valve fails to operate in the closing direction, there is a possibility of a reduction in compression ratio, a misfire and a back fire may be produced, resulting in stopping of the engine. Therefore, it is necessary to reliably operate the engine valve in the closing direction. For this purpose, it is necessary to equally increase both of the operating force in the valve-closing direction and the operating force in the valve-opening direction. As a result, in opening the engine valve, it is operated in the opening direction with an operating force larger than necessary, which wastefully causes electric power to be consumed.

SUMMARY OF THE INVENTION

It is a first object of the present invention to provide an energization control method in an electromagnetic driving device, wherein the armature can be reliably attracted to and maintained on the electromagnet irrespective of operational conditions.

To achieve the above object, according to an aspect and feature of the present invention, there is provided an energization control method in an electromagnetic driving device comprising an armature, a pair of electromagnets disposed in an opposed relation to each other on opposite sides of the armature so as to be able to apply an electromagnetic attracting force to the armature, and a pair of return springs for biasing the armature toward the electromagnets, respectively, wherein the energizing quantity for the electromagnets is varied in accordance with operational conditions.

With the above feature, it is possible to vary the attracting electromagnetic forces of the electromagnets in accordance with the operational conditions to perform the reliable attraction and maintaining of the armature and to prevent a wasteful consumption of electric power.

According to another aspect and feature of the present invention, the energizing quantity is increased in accordance with an increase in temperatures of the electromagnets. Thus, it is possible to avoid a decrease in the attracting electromagnetic forces of the electromagnets irrespective of the increase in temperatures of the electromagnets.

According to a further aspect and feature of the present invention, the energizing quantity is increased in accordance with an increase in the number of operations of the armature per unit time. Thus, it is possible to increase the attracting electromagnetic forces of the electromagnets irrespective of the increase in inertial force of the armature to perform the reliable attraction and maintaining of the armature.

According to a yet further aspect and feature of the present invention, the energizing quantity for the electromagnets is varied in accordance with the distance between the armature and the electromagnets. Thus, it is possible to avoid a wasteful consumption of electric power by the electromagnets to perform the reliable attraction and maintaining of the armature.

It is a second object of the present invention to maintain the armature on one of the electromagnets, when the attraction of the armature to the electromagnet becomes incomplete, thereby avoiding a free vibration of the armature and to prevent a disadvantage due to the generation of the free vibration.

To achieve the second object, according to the present invention, there is provided an electromagnetic control system in an electromagnetic driving device, comprising: an armature; a pair of electromagnets disposed in an opposed relation to each other on opposite sides of the armature so as to be able to exhibit an electromagnetic force for attracting the armature; a pair of return springs for biasing the armature toward the electromagnets, respectively; and an equilibrium position changing means for changing the equilibrium neutral position of the armature maintained by both the return springs in deexcited states of the electromagnets, between a first position in which the equilibrium neutral position is set at substantially halfway between the electromagnets and a second position in which the equilibrium neutral position is offset toward one of the electromagnets, the electromagnetic control system comprising, an operational position detecting means for detecting that the movement of the armature to each of the electromagnets during excitation of the electromagnets becomes incomplete; and a control means for controlling the operation of the equilibrium position changing means, so that the equilibrium neutral position of the armature is shifted to the second position in response to the detection of the incomplete movement of the armature by the operational position detecting means.

With the above arrangement, it is possible to maintain the armature on one of the electromagnets when the movement of the armature to either of the electromagnets becomes incomplete, thereby avoiding a free vibration of the armature and to prevent a disadvantage due to the generation of the free vibration.

It is a third object of the present invention to provide an electromagnetic driving device for an engine valve in an internal combustion engine, wherein the reliable closing of the engine valve can be performed, while providing an electric power-saving.

To achieve the third object, according to the present invention, the operating force in the valve-closing direction, which is a sum total of an electromagnetic force of the valve-closing electromagnet and a spring force of the valve-closing spring, is set larger than the operating force in the valve-opening direction, which is a sum total of an electromagnetic force of the valve-opening electromagnet and a spring force of the valve-opening spring. Thus, it is not necessary to use an operating force larger than necessary in order to open the engine valve, and it is possible to reliably close the engine valve, while avoiding a wasteful consumption of electric power.

Further, according to another aspect and feature of the present invention, the electromagnetic force of the valve-closing electromagnet is set larger than the electromagnetic force of the valve-opening electromagnet, so that the electromagnetic force of the valve-closing electromagnet can be varied depending upon operational conditions of the engine. Thus, it is possible to vary the valve-closing operating force in accordance with the necessary operating force varied depending upon the operational conditions of the engine, thereby reliably closing the engine valve, irrespective of the operational conditions of the engine.

The above and other objects, features and advantages of the invention will become apparent from the following description of the preferred embodiments taken in conjunction with the accompanying drawings.

DESCRIPTION OF THE PREFERRED EMBODIMENTS

The present invention will now be described by way of embodiments applied to a valve operating system for an internal combustion engine in connection with the accompanying drawings.

Figure 1:
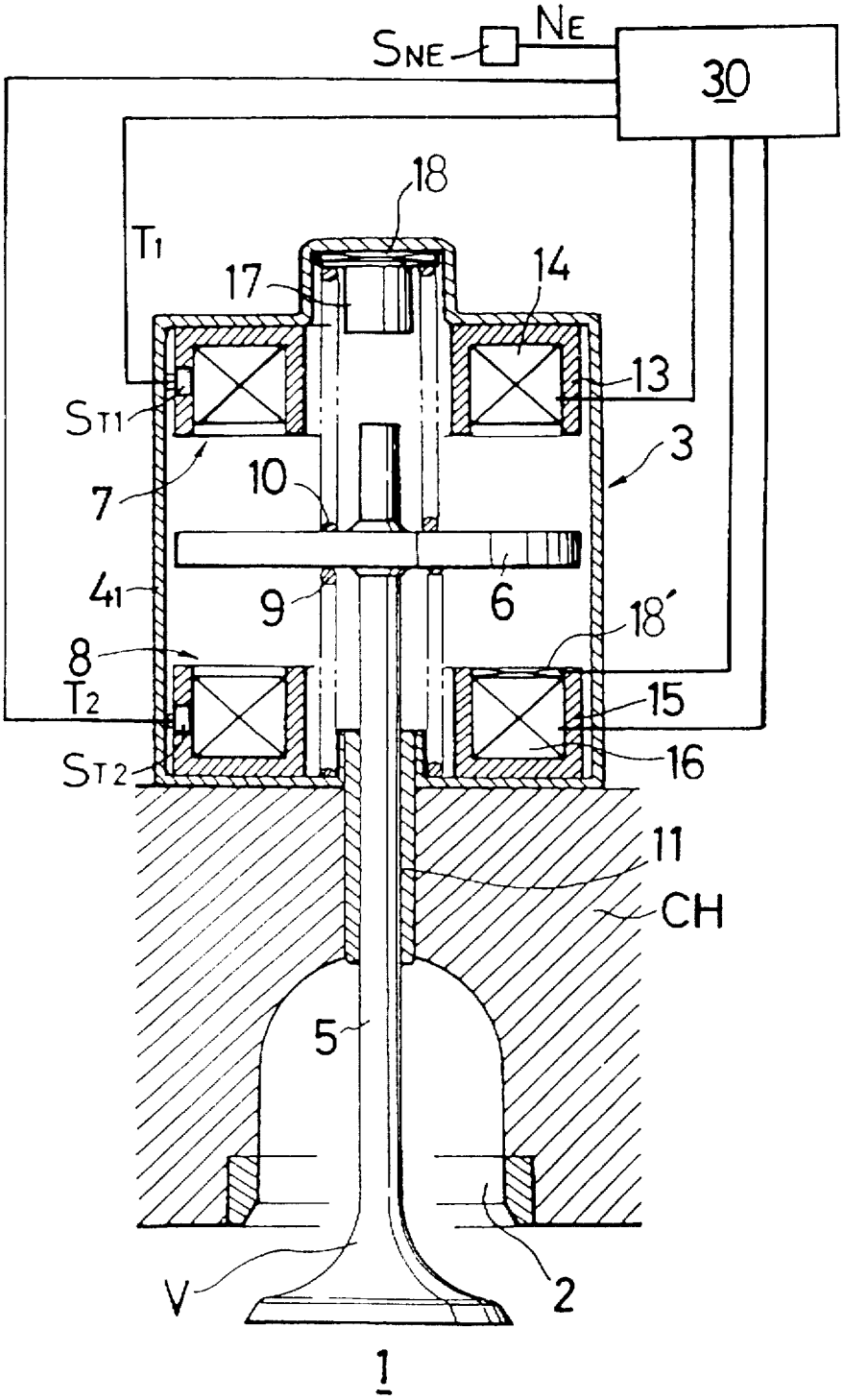
FIG. 1 is a vertical sectional view of an electromagnetic driving device according to a first embodiment of the present invention.

Referring first to FIG. 1 illustrating a first embodiment, a valve bore 2, e.g., an intake valve bore is provided in a cylinder head CH and opens into a combustion chamber 1, and an engine valve V, e.g., an intake valve for opening and closing the valve bore 2 is opened and closed by an electromagnetic driving device 3.

The electromagnetic driving device 3 includes a housing 4, made of a non-magnetic material and mounted on the cylinder head CH, an armature 6 integrally provided on a stem 5 of the engine valve V and movably contained in the housing $4_1$, a valve-closing electromagnet 7 which is fixedly disposed within the housing $4_1$ at a location opposed to an upper surface of the armature 6, and which is capable of exhibiting an electromagnetic force for attracting the armature 6 to close the engine valve V, a valve-opening electromagnet 7 which is fixedly disposed within the housing $4_1$ at a location opposed to a lower surface of the armature 6 and which is capable of exhibiting an electromagnetic force for attracting the armature 6 to open the engine valve V, a valve-closing return spring 9 for biasing the armature 6 in a direction to close the engine valve V, and a valve-opening return spring 10 for biasing the armature 8 in a direction to open the engine valve V.

The housing $4_1$ is formed into a cylindrical shape with its opposite ends closed. A guide sleeve 11, in which the stem of 5 of the engine valve V is slidably received, is fixedly mounted in the cylinder head CH to protrude into the housing $4_1$ through a lower end of the housing $4_1$. The disk-like armature 6 is provided within the housing $4_1$ and fixedly mounted on an intermediate portion of the stem 5 protruding out of the guide sleeve 11.

The valve-closing electromagnet 7 is fixedly disposed at an upper portion of the inside of the housing $4_1$ in an opposed relation to the upper surface of the armature 6, and includes a coil 14 accommodated within a stationary core 13 formed into a ring which has a substantially U-shaped cross-sectional configuration opening toward the armature 6 and which coaxially surrounds the stem 5. The valve-opening electromagnet 8 is fixedly disposed in a lower portion of the inside of the housing $4_1$ in an opposed relation to the lower surface of the armature 6, and includes a coil 16 formed into a ring which has a substantially U-shaped cross-sectional configuration opening toward the armature 6 and which coaxially surrounds the stem 5.

The valve-closing return spring 9 is accommodated in the housing $4_1$ in a manner to upwardly apply a spring force to the armature 6, and the valve-opening return spring 10 is accommodated in the housing $4_1$ in a manner to downwardly apply a spring force to the armature 6. Thus, the return springs 9 and 10 maintain the armature 6 at an equilibrium neutral position halfway between both the electromagnets 7 and 8, when the electromagnets 7 and 8 are in their deexcited states, and in this condition, the engine valve V is located halfway between a closed position and an opened position.

In order to detect that the engine valve V is located in the closed position, when the valve-closing electromagnet 7 is excited to close the engine valve V, the following components are fixedly disposed in the upper portion of the housing $4_1$: a damper 17 which is put into abutment against an upper end of the stem 5 as an interlocking member which is operated in unison with the armature 6, when the engine valve V reaches the closed position, and a piezoelectric element 18 adapted to receive a pressure from the stem 5 through the damper 17. On the other hand, in order to detect that the engine valve V is located at the opened position, when the valve-opening electromagnet 8 is excited to open the engine valve V, a piezoelectric element 18' is fixedly disposed on a surface of the valve-opening electromagnet 8 opposed to the armature 6, and is adapted to receive a pressure from the armature 6, when the engine valve V reaches the opened position.

Figure 2:
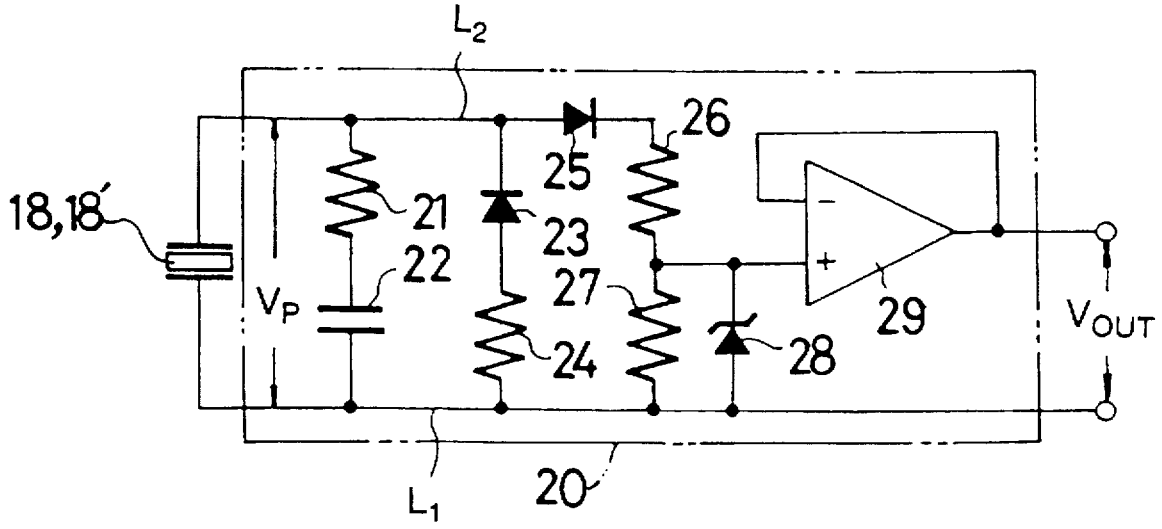
FIG. 2 is a circuit diagram illustrating the arrangement of a detector.

The piezoelectric elements 18 and 18' each have a characteristic which generates a voltage depending upon the pressures received from the armature and the stem 5. Each piezoelectric element 18, 18' is connected to a separate detector 20, as shown in FIG. 2.

The detector 20 includes a resistor 21 and a capacitor 22 which are connected in series between lines $L_1$ and $L_2$ connected to opposite ends of the piezoelectric element 18, 18', a diode 23 and a resistor 24 which are connected in series between the lines $L_1$ and $L_2$, a diode 25 and resistors 26 and 27 which are connected in series between the lines $L_1$, and $L_2$. Zener diode 28 connected between a junction between the resistors 26 and 27 and the line $L_1$, and a differential amplifier 29 having a non-inverted input terminal connected to the junction between the resistors 26 and 27 and an output terminal connected to an inverted input terminal. Thus, an output $V_{OUT}$ depending upon an output voltage $V_P$ from the piezoelectric element 18, 18' is provided between the output terminal of the differential amplifier 29 and the line $L_1$.

Figure 3:
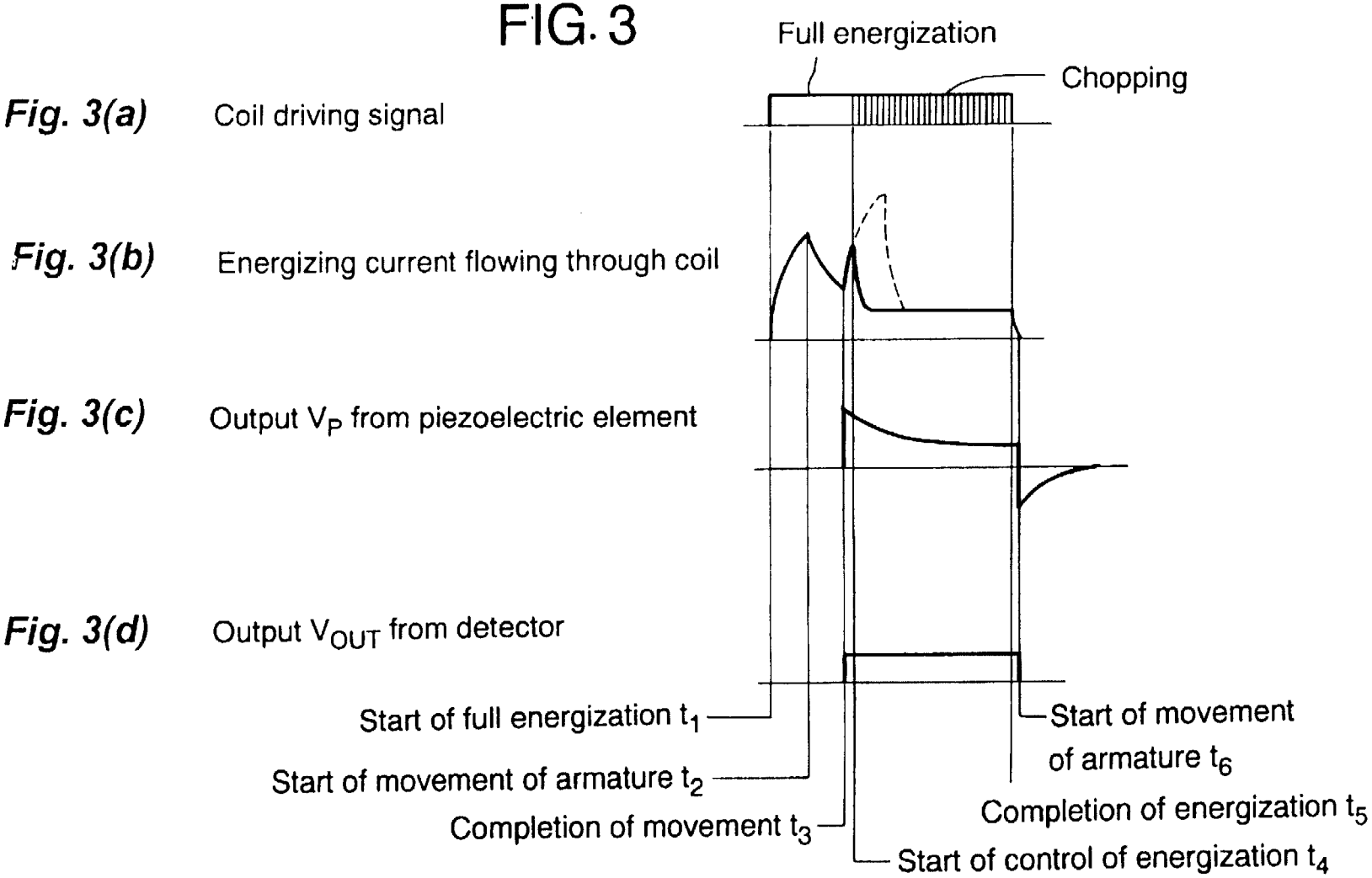
FIG. 3 is a timing chart for delivery of an output from the detector in accordance with the energization of a coil.

Timings for delivering outputs by the piezoelectric element 18, 18' and the detector 20 upon excitation of the coils 14 and 16 of the electromagnets 7 and 8 are as shown in FIG. 3. More specifically, when the full energization of the coil 14 or 16 is started at a time point $t_1$, an energizing current flows through the coil 14 or 16, as shown at (b) in FIG. 3. At a time point $t_2$ when the energizing current reaches a certain value or more, the movement of the armature 6 is started. When the movement of the armature 6 is completed at a time point $t_3$ and the energizing current is dropped in response to the starting of the movement of the armature 6, i.e., when the engine valve V reaches a fully closed position or a fully opened position, an output voltage $V_P$ is delivered from the piezoelectric element 18 or 18' in response to reception of the pressure from the armature 6, as shown at (c) in FIG. 3. Thus, the fully closed portion or the fully opened position of the engine valve V is detected by the detector 20. At a time point $t_4$ after a lapse of a short time from the detecting time point $t_3$, a chopping control for the coil 14 or 16 is started, as shown at (a) in FIG. 3, thereby limiting the energizing current, as shown at (b) in FIG. 3. Further, when the energization of the coil 14 or 16 is completed at a time point $t_5$, the armature 6 is started to be moved in the valve-opening direction or in the valve-closing direction at a time point $t_6$ at which the output from the piezoelectric element 18 or 18' is lowered.

The detector 20 is included in an electronic control unit (ECU) 30 for controlling the energization of the coils 14 and 16. Connected to the electronic control unit (ECU) 30 are a temperature detector $S_{T1}$ for detecting a temperature $T_1$, of the valve-closing electromagnet 7, a temperature detector $S_{T2}$ for detecting a temperature $T_2$ of the valve-opening electromagnet 8, and a revolution-number detector $S_{NE}$ for detecting the number $N_E$ of revolutions per unit of time of the engine.

Figure 4:
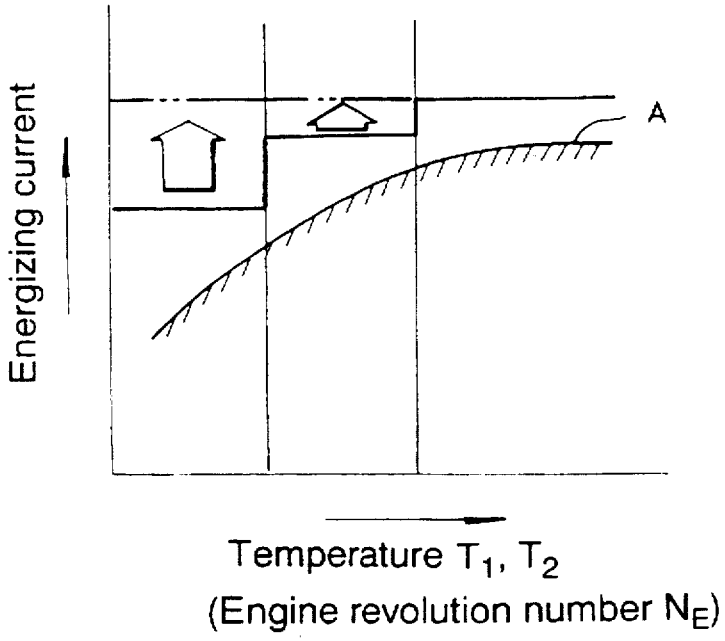
FIG. 4 is a diagram illustrating a pre-established map of energizing current.

In the electronic control unit 30, the energizing current is set as shown in FIG. 4 in accordance with the temperatures $T_1$, and $T_2$ and the engine revolution number $N_E$. More specifically, the energizing current is set so as to be stepwise increased, as the temperatures $T_1$, and $T_2$ and the engine revolution number $N_E$ are increased. A curve "A" shown in FIG. 4 indicates an energizing current such that at a current value equal to or lower than a value indicated by the curve A, there is a possibility of a failure of the holding of armature 6 by the valve-closing and -opening electromagnets 7 and 8. Therefore, the preset energizing current is set larger than the value indicated by the curve A.

The operation of the first embodiment now will be described. The attracting electromagnetic force exhibited by the valve-closing and -opening electromagnets 7 and 8 is decreased in accordance with an increase in temperature of the valve-closing and -opening electromagnets 7 and 8, if the electromagnets 7 and 8 are energized in the same energization quantity. However, the energizing current for the electromagnets 7 and 8 is stepwise increased as the temperatures $T_1$ and $T_2$ of the electromagnets 7 and 8 increase. Therefore, it is possible to prevent the decrease in attracting electromagnetic force to prevent the failure of the holding of the armature 6 by the valve-closing and -opening electromagnets 7 and 8 to the utmost, thereby achieving a reliable opening and closing operation of the engine valve V.

If the number of operations (i.e., frequency of operations) of the armature 6 per unit of time is increased in accordance with an increase in number $N_E$ of revolutions of the engine, the inertial force is increased and as a result, the failure of the holding of the armature 6 by the electromagnets 7 and 8 is liable to occur. However, the energizing current for the electromagnets 7 and 8 is stepwise increased in accordance with an increase in the number $N_E$ of revolutions of the engine, i.e., in the number of operations of the armature 6 per unit of time is increased and hence, even though the inertial force of the armature 6 is increased in accordance with the increase in the number of operations of the armature 6, the failure of the holding of the armature 6 can be prevented to the utmost by increasing the attracting electromagnetic force of the electromagnets 7 and 8, thereby providing a reliable opening and closing operation of the engine valve V.

By varying the energizing current depending upon the temperatures $T_1$ and $T_2$ of the electromagnets 7 and 8 and the number $N_E$ of revolutions of the engine, i.e., the number of operations of the armature 6 per unit of time in the above manner, it is possible to achieve a reliable operation of the armature 6 and to avoid a wasteful consumption of electric power by the electromagnets 7 and 8, thereby contributing to even a reduction in the amount of electric power consumed.

The detector 20 is capable of detecting the occurrence of the failure of the holding of the armature 6 by the electromagnets 7 and 8. When the failure of the holding of the armature 6 occurs for any reason, it is also possible to control the energizing current, so that it is increased, as indicated by the arrows in FIG. 4. Thus, it is possible to reliably attract and hold the armature 6 by either the electromagnet 7 or 8, when the failure of the holding occurs.

Figure 5:
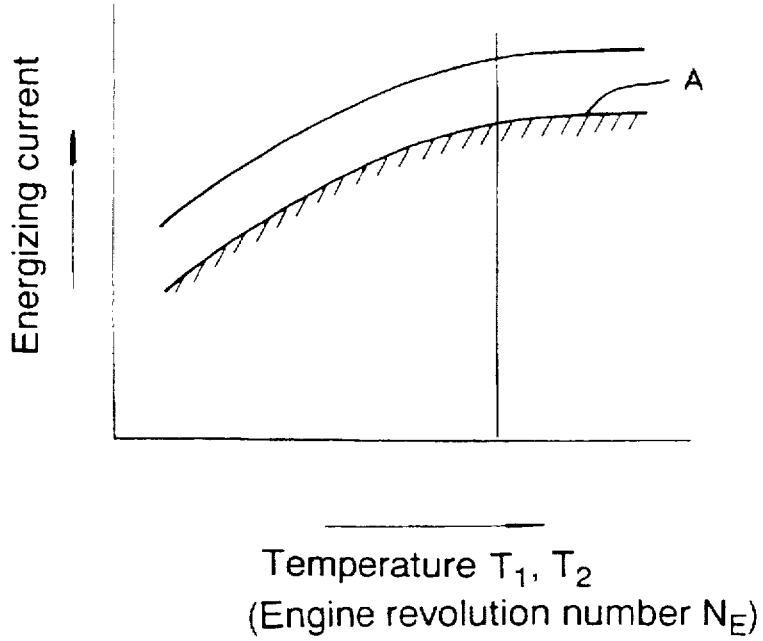
FIG. 5 is a diagram illustrating a pre-established map of energizing current in a second embodiment.

In a second embodiment of the present invention, the energizing current can be set so as to be increased smoothly in accordance with the temperatures $T_1$ and $T_2$ and the number $N_E$ of revolutions of the engine, i.e., the number of operations of the armature 6 per unit of time, as shown in FIG. 5.

In a further embodiment of the present invention, the energizing current for the electromagnets 7 and 8 may be controlled so as to be decreased as the distance between the armature 6 and the electromagnets 7 and 8 is decreased. In this case, a variation in energizing current as shown at (b) in FIG. 3 in accordance with the movement of the armature 6 may be detected to estimate the distance between the armature 6 and the electromagnets 7 and 8, or the distance may be estimated from a time lapsed from the start of the movement of the armature 6.

Thus, by decreasing the quantity of energization of the electromagnets 7 and 8 in accordance with a decrease in distance between the armature 6 and the electromagnets 7 and 8, it is possible to prevent a wasteful consumption of electric power in the electromagnets 7 and 8 and to reliably prevent the occurrence of the failure of the holding of the armature 6.

Figure 6:
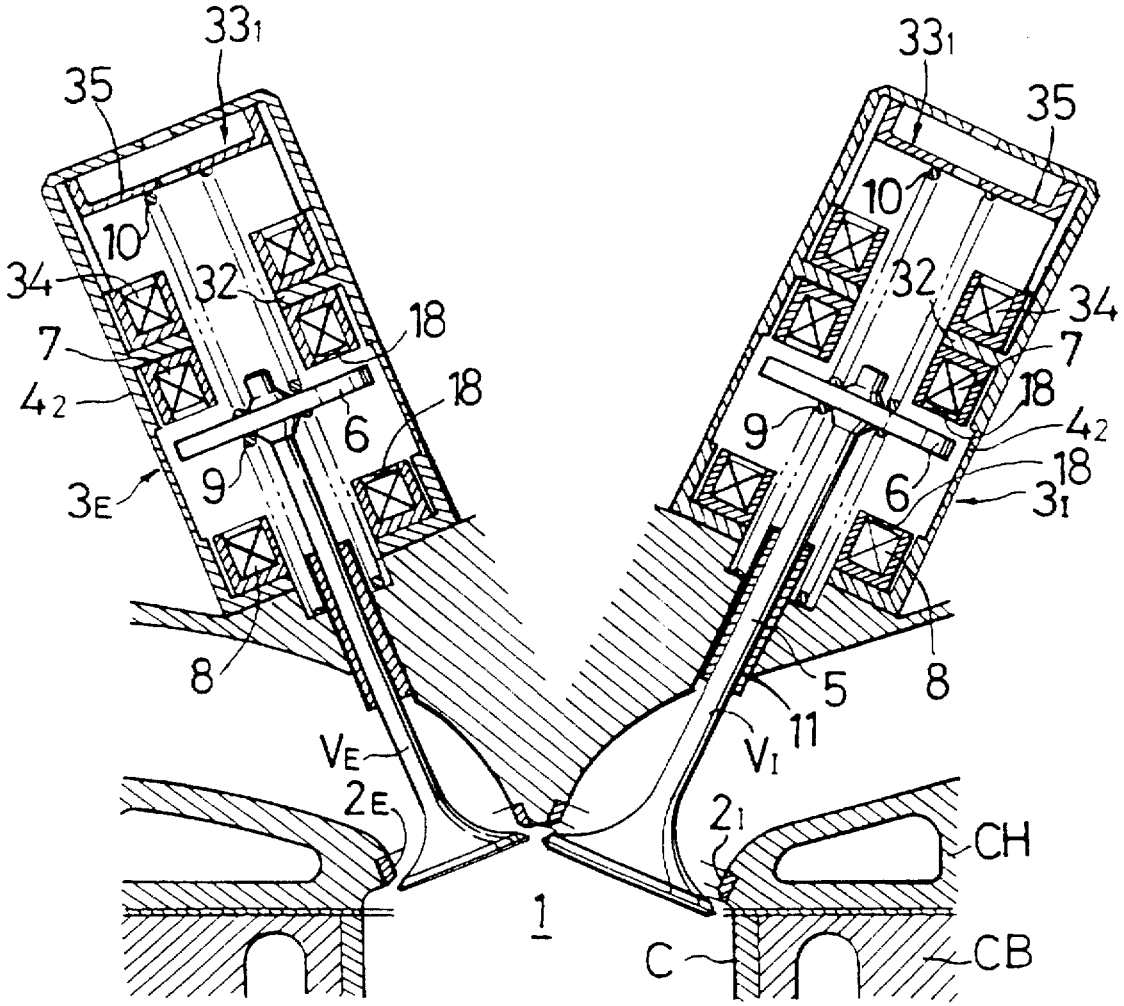
FIG. 6 is a vertical sectional view of a valve operating system for an internal combustion engine, to which a third embodiment of the present invention is applied.
Figure 7:
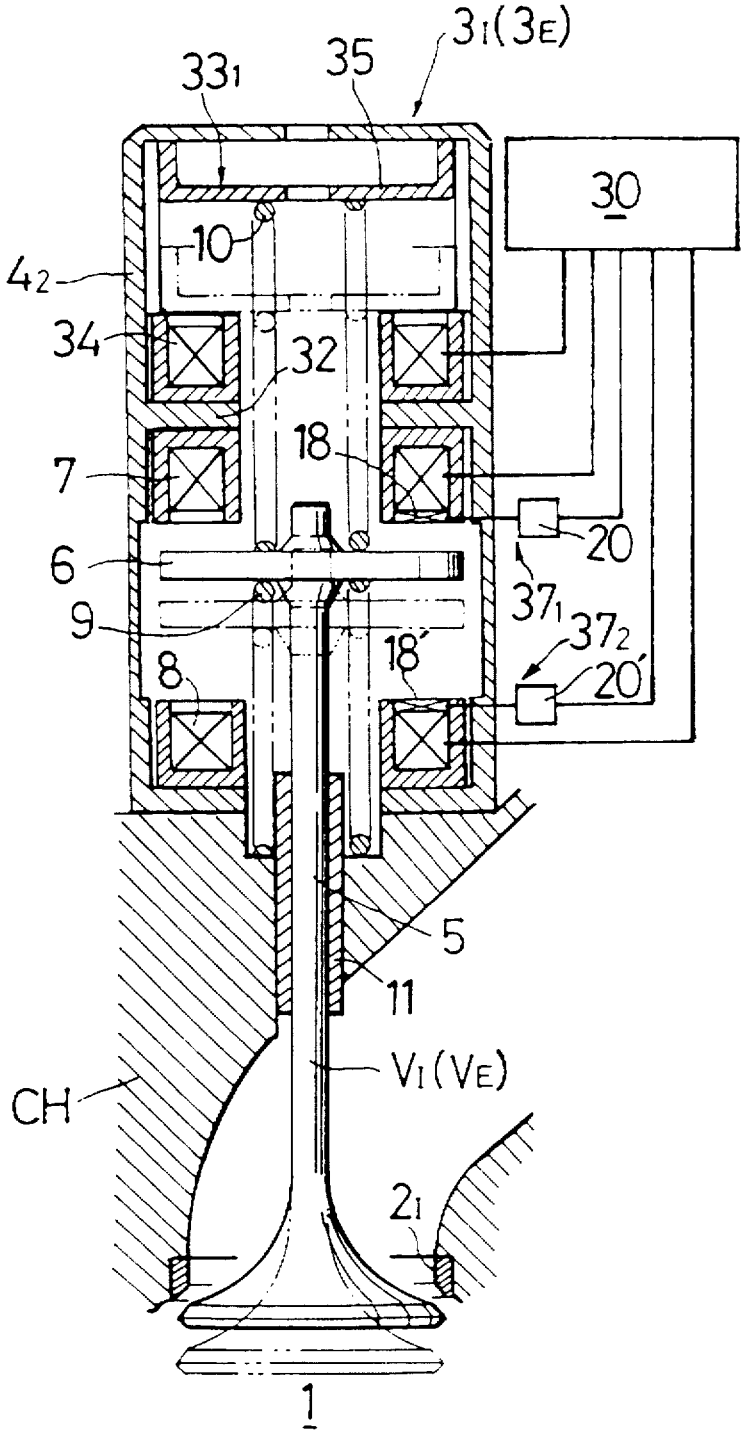
FIG. 7 is an enlarged view of an essential portion shown in FIG. 6.
Figure 8:
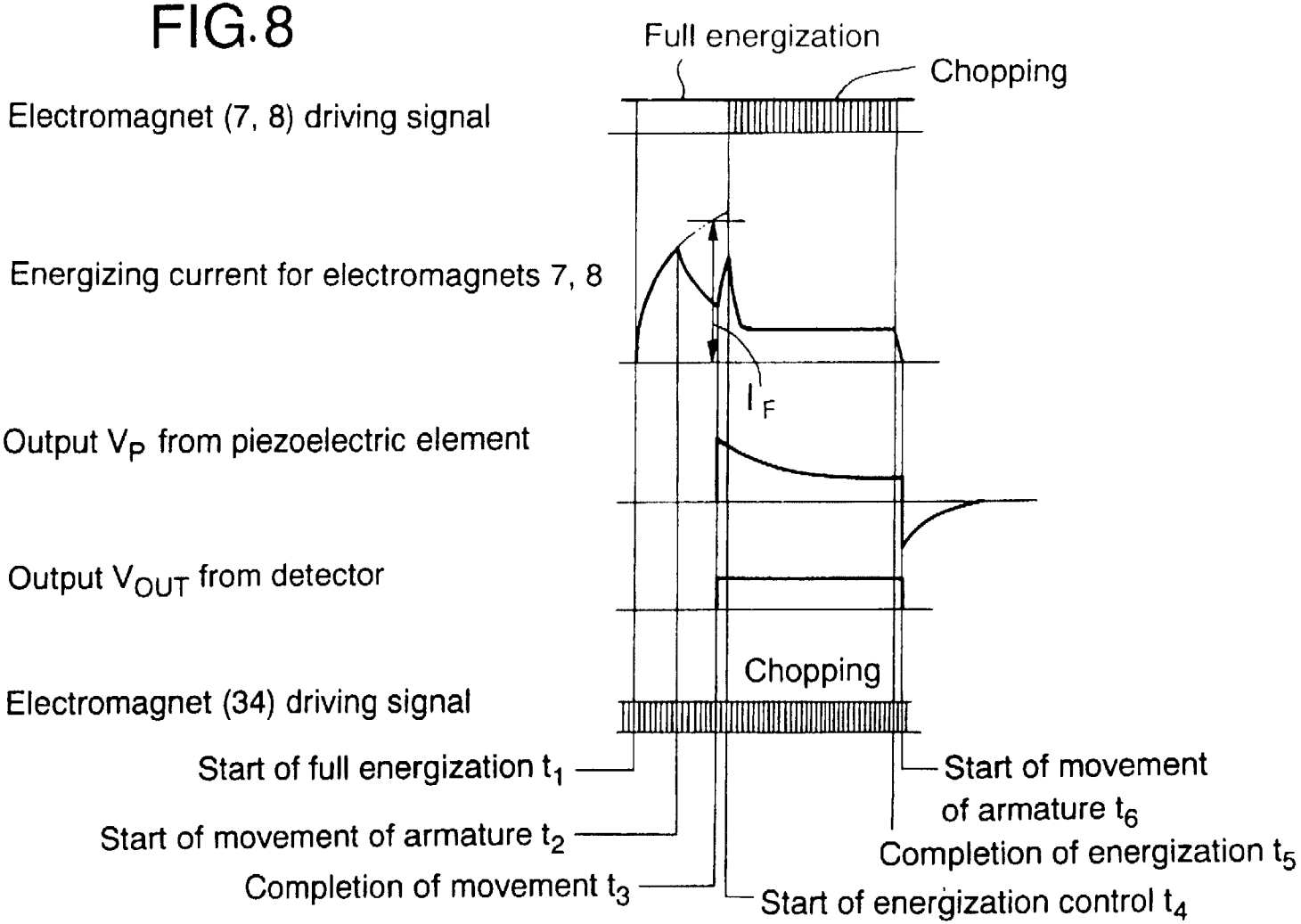
FIG. 8 is a diagram illustrating the timing for controlling the energization of each of the electromagnets and the timing for delivering a detection output from a detector.

FIGS. 6 to 8 illustrate a third embodiment of the present invention. Referring first to FIG. 6, a combustion chamber 1 is defined between a cylinder head CH coupled to an upper surface of a cylinder block CB and a piston (not shown) slidably received in a cylinder C in the cylinder block CB. An intake valve bore $2_I$ and an exhaust valve bore $2_E$ are provided in the cylinder head CH and open into the combustion chamber 1. The intake valve bore $2_I$ is opened and closed by an intake valve $V_I$, and the exhaust valve bore $2_E$ is opened and closed by an exhaust valve $V_E$.

An intake valve-side electromagnetic driving device $3_I$ is connected to the intake valve $V_I$, and an exhaust valve-side electromagnetic driving device $3_E$ is connected to the exhaust valve $V_E$. The electromagnetic driving devices $3_I$, and $3_E$ have basically the same construction and hence, only the intake valve-side electromagnetic driving device $3_I$ will be described below in detail, and for the exhaust valve-side electromagnetic driving device $3_E$, portions or components corresponding to those in the intake valve-side electromagnetic driving device $3_I$ are shown and designated by like reference characters.

Referring also to FIG. 7, the intake valve-side electromagnetic driving device $3_I$ includes a housing $4_2$ made of a non-magnetic material and mounted on the cylinder head CH, an armature 6 integrally provided on a stem 5 of the intake valve $V_I$ and movably contained within the housing $4_2$, a valve-closing electromagnet 7 which is fixedly disposed within the housing $4_2$ at a location opposed to an upper surface of the armature 6 and which is capable of exhibiting an electromagnetic force for attracting the armature 6 to close the intake valve $V_I$, a valve-opening electromagnet 8 which is fixedly disposed within the housing $4_2$ at a location opposed to a lower surface of the armature 6 and which is capable of exhibiting an electromagnetic force for attracting the armature 6 to open the intake valve $V_I$, a valve-closing return spring 9 for biasing the armature 6 in direction to close the intake valve $V_I$, and a valve-opening return spring 10 for biasing the armature 6 in a direction to open the intake valve $V_I$.

The housing $4_2$ is formed into a cylindrical shape with its opposite ends closed. A guide sleeve 11, in which the stem 5 of the intake valve $V_I$ is slidably received, is fixedly mounted in the cylinder head CH to protrude into the housing $4_2$ through a lower end of the housing $4_2$. The disk-like armature 6 is provided within the housing $4_2$ and fixed on an intermediate portion of the stem 5 protruding out of the guide sleeve 11.

The housing $4_2$ has a support collar 32 provided on an inner surface of its intermediate portion to protrude radially inwardly. The valve-closing electromagnet 7 is fixedly disposed on the support collar 32 in an opposed relation to the upper surface of the armature 6. The valve-opening electromagnet 8 is fixedly disposed at a lower portion of the inside of the housing $4_2$ in an opposed relation to the lower surface of the armature 6.

An equilibrium position changing means $33_1$ is provided in the intake valve-side electromagnetic driving device $3_I$. The equilibrium position changing means $33_1$ includes an electromagnet 34 fixedly disposed on the support collar 32 within the housing $4_2$, and a retainer 35 made of a magnetic material and opposed to the electromagnet 34. The retainer 35 is contained within the housing $4_2$ for movement between an upper limit position (a position indicated by a solid line in FIG. 7) in which the movement of the retainer 35 is limited by an upper end of the housing $4_2$ when the electromagnet 34 is deexcited, and a lower limit position (a position indicated by a dashed line in FIG. 7) in which it is attracted to the electromagnet 34 in response to the excitation of the electromagnet 34.

The valve-closing return spring 9 is compressed between a lower end of the housing $4_2$ and the armature 6, and the valve-opening return spring 10 is compressed between the retainer 35 of the equilibrium position changing means $33_1$ and the armature 6. In a condition in which the electromagnet 34 of the equilibrium position changing means $33_1$ is in its excited state and the retainer 35 is in the lower limit position, the return springs 9 and 10 function to shift the equilibrium neutral position of the armature 6 to a first position which is substantially halfway between the electromagnets 7 and 8, as shown by a dashed line in FIG. 7, in response to the deexcitation of the valve-closing electromagnet 7 and the valve-opening electromagnet 8. In this condition, the intake valve $V_I$ is at a position which is substantially halfway between the closed position and the opened position. In a condition in which the electromagnet 34 of the equilibrium position changing means $33_1$ is in its deexcited state and the retainer 35 is in the upper limit position, the return springs 9 and 10 function to shift the equilibrium neutral position of the armature 6 to a second position (a position indicated by a solid line in FIG. 7) which is in proximity to the valve-closing electromagnet 7.

An operational-position detecting means $37_1$, detects that the attractive movement of the armature 6 toward the valve-closing electromagnet 7 is incomplete during excitation of the valve-closing electromagnet 7, and an operational-position detecting means $37_2$ detects that the attractive movement of the armature 6 toward the valve-opening electromagnet 8 is incomplete during excitation of the valve-opening electromagnet 8. The operational-position detecting means $37_1$ includes a piezoelectric element 18 fixedly disposed on a surface of the valve-closing electromagnet 7 opposed to the armature 6, and a detector 20, as shown in FIG. 2, for detecting that the movement of the armature 6 to the valve-closing electromagnet 7 is incomplete, in accordance with an output from the detector. The operational-position detecting means $37_2$ includes a piezoelectric element 18' fixedly disposed on a surface of the valve-opening electromagnet 8 opposed to the armature 6, and a detector 20' for detecting that the movement of the armature 6 to the valve-opening electromagnet 8 is incomplete, in accordance with an output from the detector. Each of the piezoelectric elements 18, 18' is fixedly disposed on the surface of each of the valve-closing and valve-opening electromagnets 7 and 8 opposed to the armature 6, so that it receives a pressure from the armature 6, when the movement of the armature 6 is complete. The detector 20, 20' is constructed in the same manner as the detector shown in FIG. 2.

The timings of delivery of outputs by the piezoelectric elements 18, 18' and the detectors 20, 20' upon excitation of the valve-closing and valve-opening electromagnets 7 and 8 are as shown in FIG. 8. More specifically, in case the movement of the armature 6 is normal, when the full energization of the valve-closing or valve-opening electromagnet 7 or 8 is started at a time point $t_1$, as shown at (a) in FIG. 8, an energizing current flows through the valve-closing or valve-opening electromagnet 7 or 8, as shown at (b) in FIG. 8. At a time point $t_2$ when the energizing current reaches a certain value or more, the movement of the armature 6 is started. When the movement of the armature 6 is completed at a time point $t_3$ at which the energizing current is decreased in response to the start of the movement of the armature 6, i.e., when the intake valve $V_1$, reaches its fully closed position or its fully opened position, an output voltage $V_P$ is delivered from the piezoelectric element 18, 18' in response to reception of the pressure from the armature 6, as shown at (c) in FIG. 8. At a time point $t_4$ after a lapse of a short time from the detecting time point $t_3$, a chopping control of the valve-closing or valve-opening electromagnet 7 or 8 is started as shown at (a) in FIG. 8, thereby limiting the energizing current, as shown at (b) in FIG. 8. When the energization of the valve-closing or valve-opening electromagnet 7 or 8 is completed at a time point $t_5$, the movement of the armature 6 in a valve opening direction or valve closing direction starts at a time point $t_6$ at which point the output from the piezoelectric element 18, 18' is decreased.

In case the movement of the armature 6 is incomplete, no output is delivered from the detector 20, 20' during full energization of the valve-closing or valve-opening electromagnet 7 or 8, and the energizing current for the valve-closing or valve-opening electromagnet 7 or 8 is increased, as shown by a dashed line at (b) in FIG. 8. Therefore, it is possible to determine that the movement of the armature 6 is incomplete by the fact that no output is delivered from the detector 20, 20' up to the time point $t_4$ at which the full energization of the valve-closing or valve-opening electromagnet 7 or 8 is completed, or by the fact that the energizing current for the valve-closing or valve-opening electromagnet 7 or 8 is increased to a value larger than a predetermined value $I_F$.

The operational position detecting means $37_1$, and $37_2$ are connected to an electronic control unit 30 as a control means. The electronic control unit 30 controls the energization of the valve-closing and valve-opening electromagnets 7 and 8 in response to timings of opening and closing the intake valve $V_I$ and the exhaust valve $V_E$, and excites the valve-closing and valve-opening electromagnets 7 and 8 with a chopping current such as shown at (e) in FIG. 8 during operation of the engine. However, when the movement of the armature 6 is incomplete, the electronic control unit 30 controls the energization of the electromagnet 34 of the equilibrium position changing means $33_1$ so that the electromagnet 34 is deexcited. In other words, when the movement of the armature 6 is normal, the equilibrium position changing means $33_1$ shifts the equilibrium neutral position of the armature 6 to a first position which is substantial halfway between the valve-closing and valve-opening electromagnets 7 and 8. When the movement of the armature 6 becomes incomplete, the equilibrium position changing means $33_1$ shifts the equilibrium neutral position of the armature 6 to a second position which is in proximity to the valve-closing electromagnet 7.

The operation of the third embodiment now will be described. During operation of the engine, the electromagnet 34 of the equilibrium position changing means $33_1$ is maintained in a state energized with the chopping current, and the equilibrium neutral position of the armature 6 is established at the first position which is substantial halfway between the valve-closing and valve-opening electromagnets 7 and 8. Therefore, the armature 6 is selectively attracted to the electromagnet 7 or 8 for operation in response to the control for switching over the energized states of the valve-closing and valve-opening electromagnets 7 and 8, thereby opening and closing the intake valve $V_I$ and the exhaust valve $V_E$.

When it is detected by the operational position detecting means $37_1$ or $37_2$ that the movement of the armature 6 to the valve-closing and valve-opening electromagnet 7 or 8 is incomplete during operation of the engine, the equilibrium position changing means $33_I$ shifts the equilibrium neutral position of the armature 6 to the second position which is in proximity to the valve-closing electromagnet 7. More specifically, the equilibrium neutral position of the armature 6 is established at a position in which the intake valve $V_I$ and the exhaust valve $V_E$ are substantially fully closed. Thus, it is possible to reliably prevent the armature 6 from starting a free vibration, by the spring forces of the valve-closing and valve-opening return springs 9 and 10, thereby reliably avoiding an interference of the intake valve $V_I$ and the exhaust valve $V_E$ with the piston and an interference of the intake and exhaust valves $V_I$ and $V_E$ with each other, and preventing the generation of a different sound and a defective deformation and operation of the piston and the intake and exhaust valves $V_I$ and $C_E$.

Figure 9:
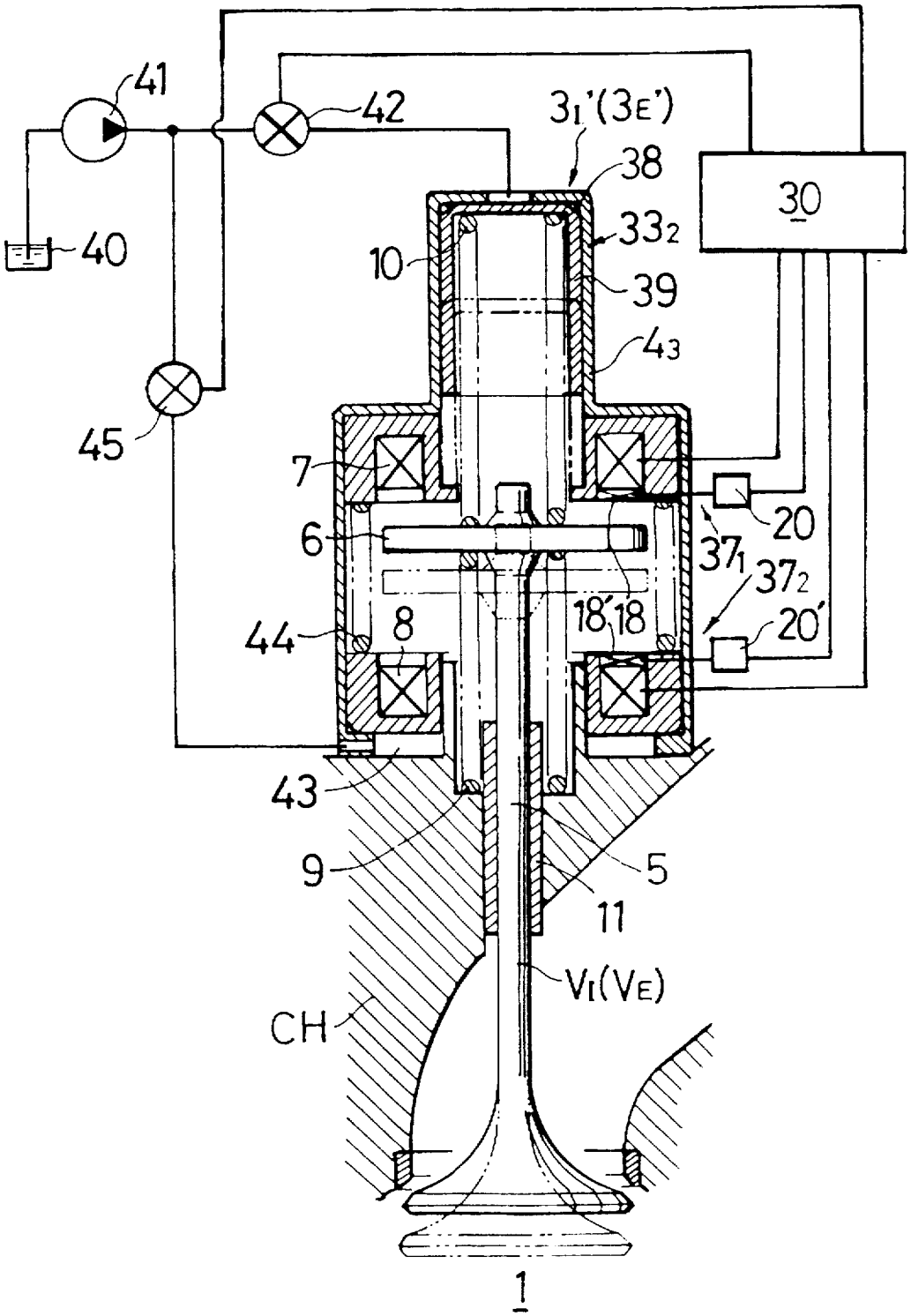
FIG. 9 is a sectional view similar to FIG. 7, but illustrating a fourth embodiment of the present invention.

FIG. 9 illustrates a fourth embodiment of the present invention, wherein portions or components corresponding to those in the third embodiment shown in FIGS. 6 to 8 are designated by like reference characters.

An equilibrium position changing means $33_2$ is provided in an intake valve-side electromagnetic driving device $3_I$' and an exhaust valve-side electromagnetic driving device $3_E$'. The equilibrium position changing means $33_2$ includes a position adjusting piston 39 which is slidably received in an upper portion of the inside of a housing $4_3$ to define a fluid pressure chamber 38 between the position adjusting piston 39 and an upper end of the housing $4_3$ and which receives an end of a valve-opening return spring 10, a pump 41 for pumping a working fluid from a reservoir 40, and a switch-over control valve 42 which is switchable between a state in which it permits the working fluid to be supplied from the pump 41 to the fluid pressure chamber 38 and a state in which it permits the working fluid in the fluid pressure chamber 38 to escape.

The valve-opening electromagnet 8 is slidably fitted in a lower portion of the housing $4_3$ to define a fluid pressure chamber 43 between the electromagnet 8 and a lower end of the housing $4_3$ which fluid pressure chamber 43 is connected to the pump 41 through a switch-over control valve 45. Moreover, a spring 44 is compressed between the valve-closing and valve-opening electromagnets 7 and 8. The switch-over control valve 45 is switchable between a state in which it permits the communication of the fluid pressure chamber 43 with the pump 41 and a state in which it opens the fluid pressure chamber 43. If a fluid pressure delivered by the pump 41 is applied to the fluid pressure chamber 43, the valve-opening electromagnet 8 is lifted up to a position in which an upward fluid pressure force provided by a fluid pressure in the fluid pressure chamber 43 is balanced with a downward spring force provided by the spring 44. This enables a reduction in maximum lift amount for opening each of the intake and exhaust valves $V_I$ and $V_E$.

The switching-over of the switch-over control valve 42 of the equilibrium position changing means $33_2$ and the switch-over control valve 45 for controlling the position of the valve-opening electromagnet 8 is controlled by an electronic control unit 30. When it is detected by the operational position detecting means $37_1$, or $37_2$ that the movement of the armature 6 is incomplete, the electronic control unit 30 operates the switch-over control valve 42 to release the fluid pressure in the fluid pressure chamber 38, so that a second position in which the armature 6 is in proximity to the valve-closing electromagnet 7 is an equilibrium neutral position, as shown by a solid line in FIG. 9. When the movement of the armature 6 is normal, the electronic control unit 30 operates the switch-over control valve 42 to apply the fluid pressure to the fluid pressure chamber 38, so that the equilibrium neutral position of the armature is shifted to a first position which is substantially halfway between the valve-opening electromagnet 8 located at a lower position and the valve-closing electromagnet 7 located at an upper fixed position, as shown by a dashed line in FIG. 9.

Even in the fourth embodiment, when the movement of the armature 6 becomes incomplete the equilibrium neutral position of the armature is shifted to the position in proximity to the valve-closing electromagnet 7, thereby bringing the intake and exhaust valves $V_I$ and $V_E$ to their substantially closed positions. Therefore, it is possible to reliably prevent the armature 6 from starting a free vibration, thereby reliably avoiding an interference of the intake and exhaust valves $V_I$ and $V_E$ with the piston and an interference of the intake and exhaust valves $V_I$ and $V_E$ with each other, and preventing the generation a different sound and a defective deformation and operation of the piston and the intake and exhaust valves $V_I$ and $V_E$.

The above-described first to fourth embodiments are widely applicable not only to the valve operating device but also to any electromagnetic driving device including an operating member connected to an armature.

A fifth embodiment of the present invention will be described with reference to FIGS. 10 to 12.

Figure 10:
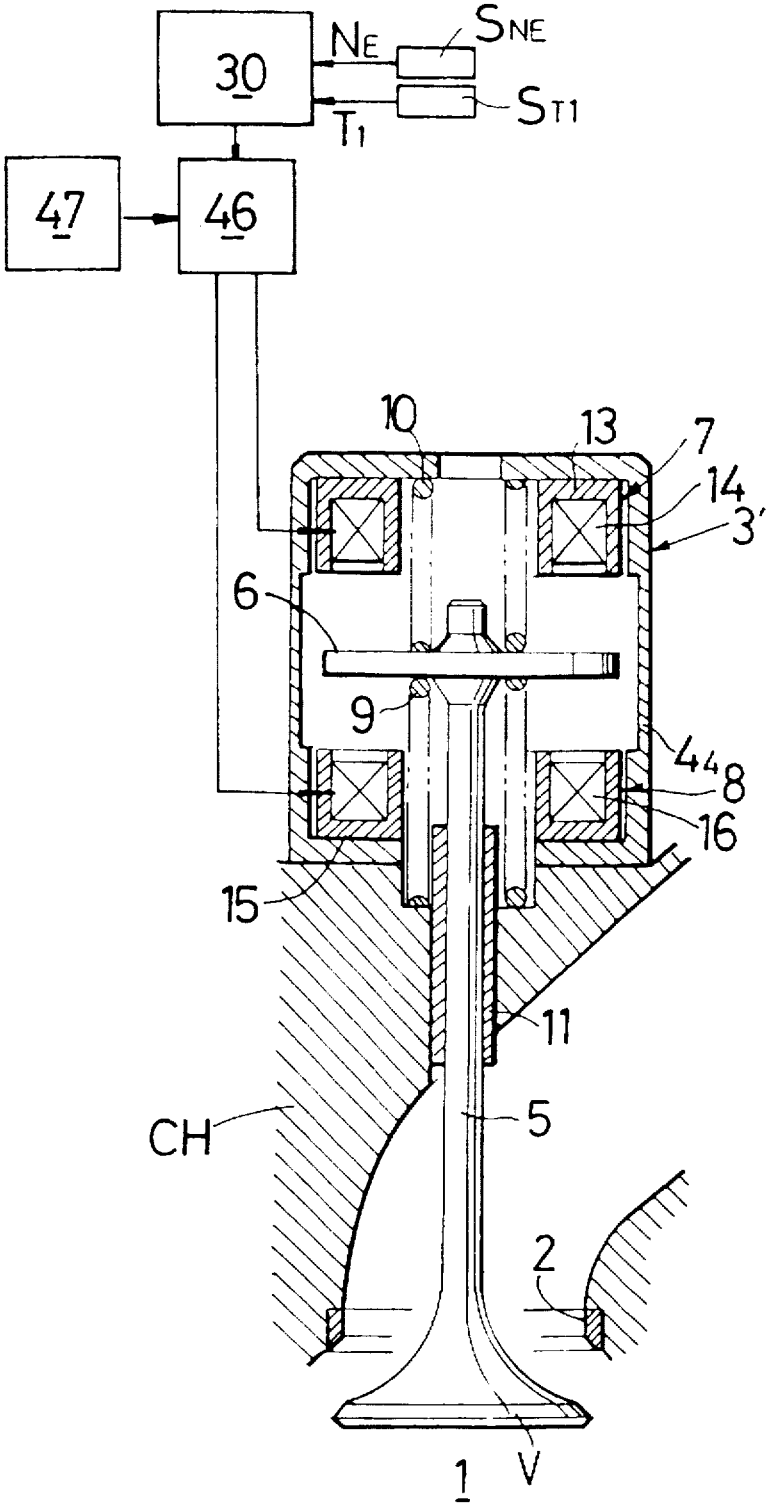
FIG. 10 is a vertical sectional view of an electromagnetic driving device according to a fifth embodiment of the present invention.

Referring first to FIG. 10, an engine valve V as an intake valve for opening and closing a valve bore 2, e.g., an intake valve bore in a cylinder head CH, is opened and closed by an electromagnetic driving device 3'. The electromagnetic driving device 3' includes a housing $4_4$ made of a non-magnetic material and mounted on the cylinder head CH, an armature 6 fixedly provided on a stem 5 of the engine valve V and movably contained within the housing $4_4$, a valve-closing electromagnet 7 which has a coil 14 accommodated within a stationary core 13 and which is fixedly disposed within the housing $4_4$ at a location opposed to an upper surface of the armature 6, a valve-opening electromagnet 8 which has a coil 16 accommodated within a stationary core 15 and which is fixedly disposed within the housing $4_4$ at a location opposed to a lower surface of the armature 6, a valve-closing return spring 9 compressed between a lower end of the housing $4_4$ and the armature 6 to exhibit a spring force for biasing the armature 6 in a direction to close the engine valve V, and a valve-opening return spring 10 compressed between an upper end of the housing $4_4$ and the armature 6 to exhibit a spring force for biasing the armature 6 in a direction to open the engine valve V. When the electromagnets 7 and 8 are in their deexcited states, the return springs 9 and 10 retain the armature 6 at an equilibrium neutral position which is halfway between both the electromagnets 7 and 8. In this condition, the engine valve V is located at a middle position between a closed position and an opened position.

A power supply 47 is connected through an amplifier 46 to the coil 14 of the valve-closing electromagnet 7 and the coil 16 of the valve-opening electromagnet 8. The amplification degree of the amplifier 46 is controlled by an electronic control unit 30. The electronic control unit 30 controls the energizing quantity for the electromagnets 7 and 8, so that the electromagnetic force of the valve-closing electromagnet 7 is varied in accordance with the valve detected by a revolution-number detector $S_{NE}$ for detecting a number $N_E$ of revolutions of the engine and the value detected by a temperature detector $ST_1$ for detecting a temperature $S_{T1}$ of the valve-closing electromagnet 7, which has an electromagnetic force that is always larger than the electromagnetic force of the valve-opening electromagnet 8.

An electromagnetic force F of each of the valve-closing and valve-opening electromagnets 7 and 8 per unit area is determined according to the following expression from an electric current value I, a number N of turns of coils 14 and 16 and a distance L between each of the valve-closing and valve-opening electromagnets 7 and 8 and the armature 6:

$$F \alpha (I \cdot N/L^2)$$

Therefore, in order to set the electromagnetic force provided in a valve-closing direction by the valve-closing electromagnet 7 at a value larger than the electromagnetic force provided in a valve-opening direction by the valve-opening electromagnet 8, the electric current value I, the number N of turns and the area opposed to the armature 6 may be increased, or the distance may be decreased. Each of the number N of turns, the area opposed to the armature 6 and the distance L is a fixed value. In order to vary the electromagnetic force in accordance with the number $N_E$ of revolutions of the engine and the temperature $T_1$, the electric current value I may be varied.

Figure 11:
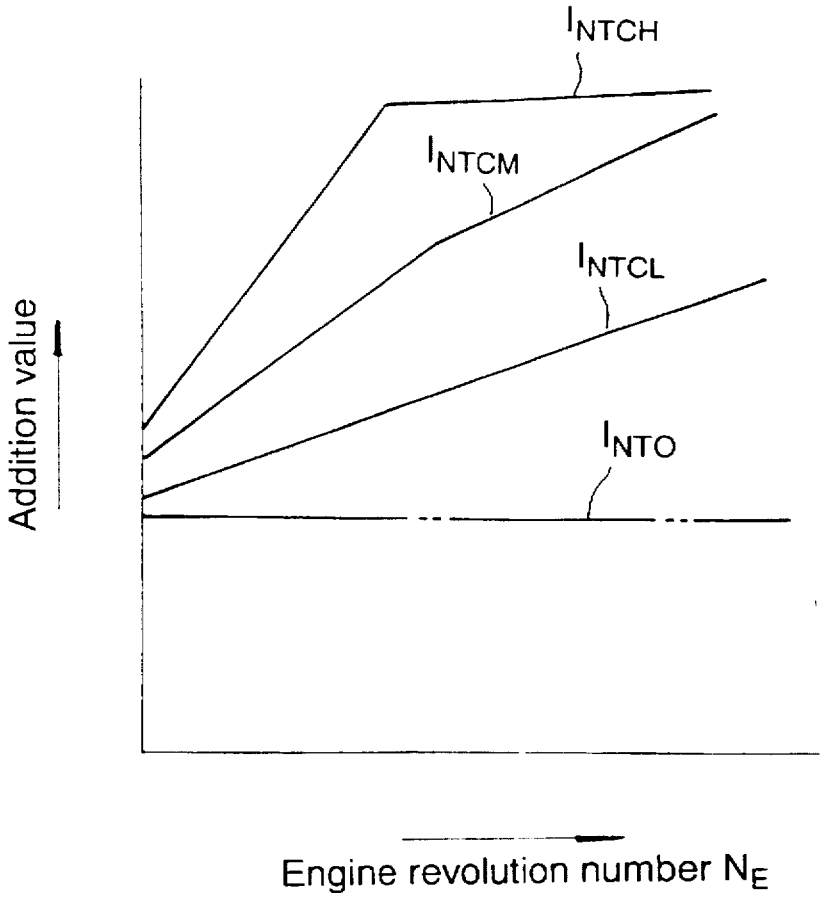
FIG. 11 is a diagram illustrating the variation in electromagnetic force in accordance with the number of revolutions of the engine and the temperature of the electromagnets.

If the energizing quantity $I_C$ for the valve-closing electromagnet 7 is set to a value ($I_B$+$I_{NTC}$) resulting from the addition of an addition value $I_{NTC}$ dependent upon the engine revolution number $N_E$ and the temperature $T_1$ to a basic value $I_B$, and the energizing quantity I-O for the valve-opening electromagnet 8 is set to a value ($I_B$+$I_{NTO}$) resulting from the addition of an addition value $I_{NTO}$ dependent upon the engine revolution number $N_E$ and the temperature $T_1$, to the basic value $I_B$, the addition values $I_{NTC}$ and $I_{NTO}$ are determined as shown in FIG. 11. More specifically, the addition value $I_{NTO}$ in the valve-opening electromagnet 8 is determined as a constant as shown by a dashed line in FIG. 11, irrespective of the engine revolution number $N_E$ and the temperature $T_1$, while the addition value $I_{NTC}$ in the valve-closing electromagnet 7 is as shown by one of the solid lines in FIG. 11, namely, it is set at $I_{NTCL}$ when the temperature is $T_1$, is lower; at $I_{NTCM}$ when the temperature $T_1$, is medium, and at $I_{NTCH}$ when the temperature is $T_1$ is higher. The addition value $I_{NTC}$ in the valve-closing electromagnet 7 is always larger than the addition value $I_{NTO}$ in the valve-opening electromagnet 8, and the addition value $I_{NTC}$ is gradually increased as the engine revolution number $N_E$ is increased.

Figure 12:
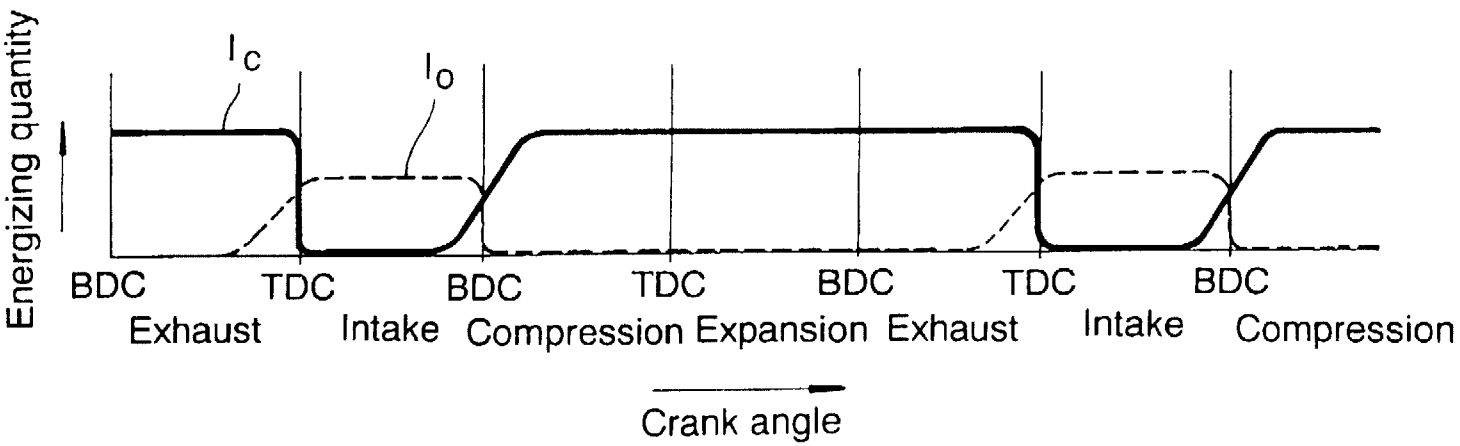
FIG. 12 is a diagram illustrating the energizing timing and the energizing quantity for the valve-closing and valve-opening electromagnets.

The energization of the electromagnets 7 and 8 is controlled in accordance with a crank angle and the energizing quantity $I_c$ (=$I_B$+$I_{NTC}$) for the valve-closing electromagnet 7 shown by a solid line in FIG. 12 is larger than the energizing quantity $I_O$(=$I_B$+$I_{NTO}$) for the valve-opening electromagnet 8 shown by a dashed line in FIG. 12.

The operation of the fifth embodiment now will be described. By the fact that the operating force provided in the valve closing direction by the valve-closing electromagnet 7 and the valve-closing return spring 9 is larger than the operating force provided in the valve-opening direction by the valve-opening electromagnet 8 and the valve-opening return spring 10, it is possible to reliably operate the engine valve V in the closing direction, thereby preventing a reduction in compression ratio, a misfire, a back fire and the like from being produced due to a failure of the operation of the engine valve in the closing direction.

Moreover, by setting the operating force in the valve-closing direction larger than the operating force in the valve-opening direction by setting the electromagnetic force of the valve-closing electromagnet 7 larger than the electromagnetic force of the valve-opening electromagnet 8, it is possible to insure the reliable opening operation of the engine valve V by the valve-opening electromagnet 8 and moreover to provide the reliable operation of the engine valve V, when the engine valve is closed, thereby suppressing an increase in consumption of electric power.

The electromagnetic force of the valve-closing electromagnet 7 is increased, as the engine revolution number $N_E$ is increased. Thus, it is possible to deal with a decrease in attraction permitting time with an increase in engine revolution number $N_E$. Further, it is possible to deal with an increase in resistance to the energization of the coil 14 in the valve-closing electromagnet 7 with an increase in temperature.

Figure 13:
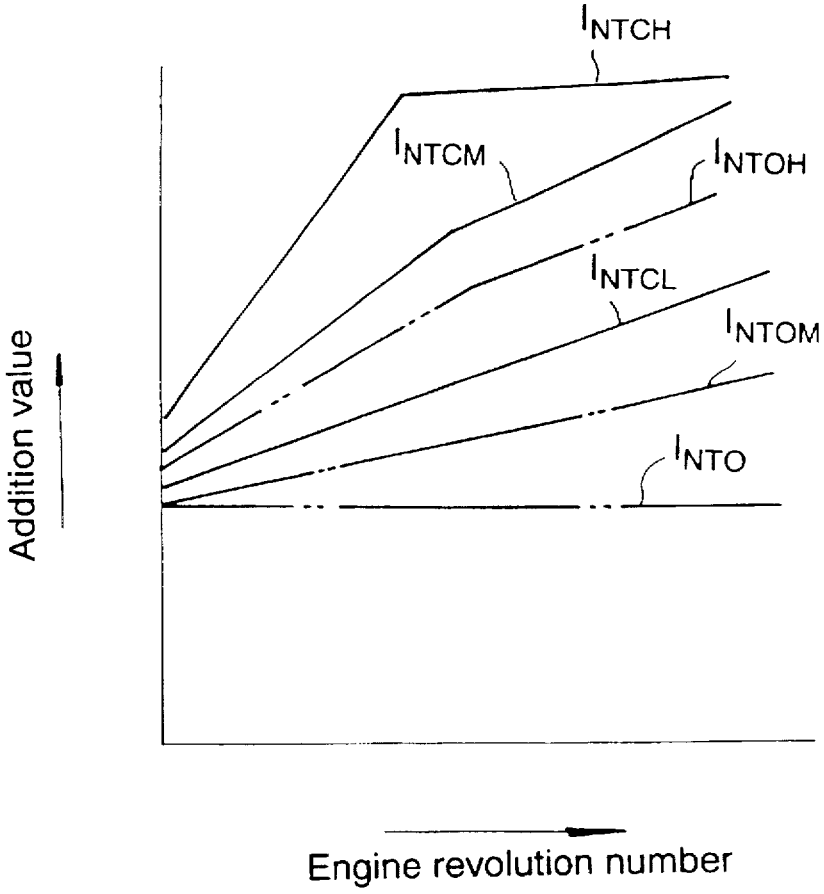
FIG. 13 is a diagram illustrating the variation in electromagnetic force in accordance with the number of revolutions of the engine and the temperature of the electromagnets in a sixth embodiment of the present invention.

In a sixth embodiment of the present invention, the addition value $I_{NTO}$ in the valve-opening electromagnet 8 may be set as shown by one of the dashed lines in FIG. 13, namely, it is set at $I_{NTCL}$ when the temperature $T_1$ is lower; at $I_{NTCM}$ when the temperature $T_1$ is medium, and at $I_{NTCH}$ when the temperature $T_1$ is higher. In other words, the addition value $I_{NTO}$ in the valve-opening electromagnet 8 may be set so that it is increased, as the engine revolution number $N_E$ is increased and the temperature $T_1$ increases. However, even when the temperature $T_1$ is any one of the lower, medium and higher values, the addition value $I_{NTO}$ in the valve-opening electromagnet 8 is less than the addition value $I_{NTC}$ in the valve-closing electromagnet 7.

In an alternative embodiment, the temperature of a lubricating oil for the engine may be detected, and the energizing quantity for the valve-closing electromagnet 7 may be controlled so as to be increased as the temperature is lowered. Thus, it is possible to deal with an increase in the distance between the armature 6 and the valve-closing electromagnet 7 due to a lowering of the engine temperature, resulting in a difficulty to close and retain the engine valve. The energizing quantity for the valve-closing electromagnet 7 may be controlled in response to an ignition signal so as to be increased at the start of the engine. Thus, it is likewise possible to deal with a problem as described above, when the engine temperature is lower.

Figure 14:
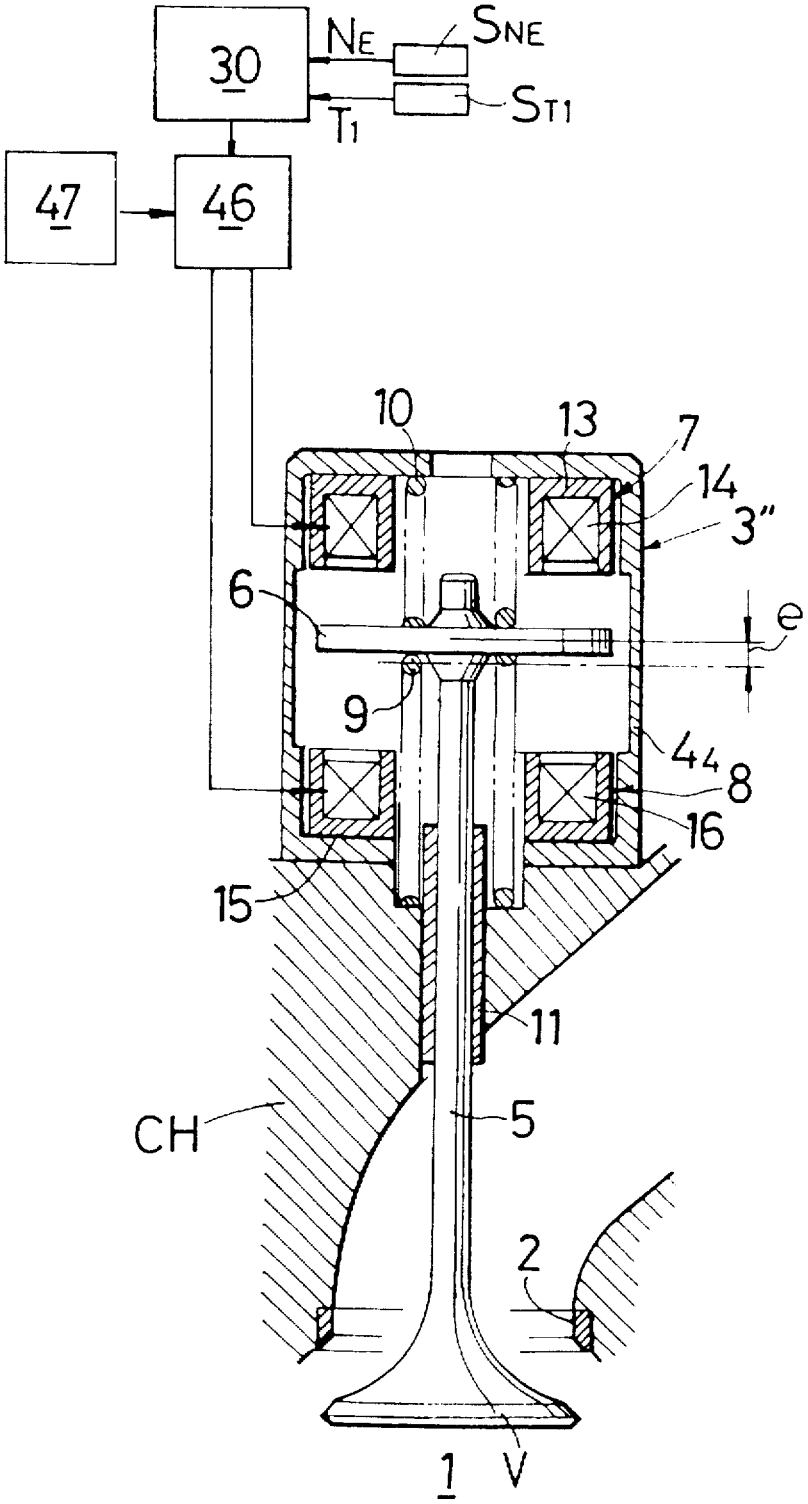
FIG. 14 is a vertical sectional view of an electromagnetic driving device according to a seventh embodiment of the present invention.

FIG. 14 illustrates a seventh embodiment of the present invention, wherein portions or components corresponding to those in the above-described embodiments are designated by like reference characters.

In an electromagnetic driving device 3", the spring constant of the valve-closing return spring 9 that is compressed between the lower end of the housing $4_4$ and the armature 6 is larger than the spring constant of the valve-opening return spring 10 that is compressed between the upper end of the housing $4_4$ and the armature 6. Thus, the equilibrium neutral position of the armature 6 determined by the return springs 9 and 10 when the electromagnets 7 and 8 are in their deexcited states, is offset toward the valve-closing electromagnet 7 by an offset amount e from a middle portion between both the electromagnets 7 and 8.

Even in the seventh embodiment, the operating force provided in the valve closing direction by the valve-closing electromagnet 7 and the valve-closing return spring 9 is larger than the operating force provided in the valve-opening direction by the valve-opening electromagnet 8 and the valve-opening return spring 10. Therefore, it is possible to reliably operate the engine valve V in the closing direction, thereby preventing a reduction in compression ratio, a misfire, a back fire and the like from being produced due to a failure of the operation of the engine valve in the closing direction.

If the equilibrium neutral position of the armature 6 is offset toward the valve-closing electromagnet 7 from the middle portion between both the electromagnets 7 and 8, the reliable closing operation of the engine valve V is achieved, but an increase in electromagnetic force of the valve-opening electromagnet 8 is unavoidable. Therefore, the seventh embodiment is particularly effective, when the lift amount of the engine valve is relatively small, and the engine valve V can be opened, even if the electromagnetic force of the valve-opening electromagnet 8 is not so increased.

The spring constant of each of the return springs 9 and 10 is a fixed value, as is the above-described spring constant. However, it is possible to increase the operating force in the valve closing direction to achieve the initial purpose, such as by increasing the number of turns of the coil 14 in the valve-closing electromagnet 7, by increasing the area of the valve-closing electromagnet 7 opposed to the armature 6, or by setting the distance between the valve-closing electromagnet 7 and the armature 6.

Although preferred embodiments of the present invention have been described in detail, it will be understood that the present invention is not limited to the above-described embodiments, and various modifications in design may be made without departing from the spirit and scope of the invention defined in claims.

What is claimed is:

1. An electromagnetic driving device for an engine valve in an internal combustion engine, comprising; an armature operatively connected to the engine valve; a pair of electromagnets disposed in an opposed relation to each other on opposite sides of said armature for selectively applying an electromagnetic attracting force to said armature for opening and closing the engine valve; a pair of return springs for biasing said armature toward said electromagnets, respectively; means for estimating a distance between said armature and said electromagnets; and means for varying an energizing quantity applied to said electromagnets in accordance with the estimated distance between said armature and said electromagnets.

2. An electromagnetic driving device of claim 1, wherein said estimating means estimates said distance by detecting a variation in energizing current for the electromagnets in accordance with a movement of said armature.

3. An electromagnetic driving device of claim 1, wherein said estimating means estimate said distance by detecting a time lapsed from the start of a movement of said armature.

4. An energization control system in an electromagnetic driving device for an engine valve in an internal combustion engine, the driving device comprising: an armature operatively connected to the engine valve; a pair of electromagnets disposed in an opposed relation to each other on opposite sides of said armature for selectively applying an electromagnetic attracting force to said armature for opening and closing the engine valve; a pair of return springs for biasing said armature toward said electromagnets, respectively;

means for estimating a distance between said armature and said electromagnets; and wherein an energizing quantity for said electromagnets is varied in accordance with the estimated distance between said armature and said electromagnets.

5. An energization control system of claim 4, wherein said estimating means estimates said distance by detecting a variation in energizing current for the electromagnets in accordance with a movement of said armature.

6. An energization control system of claim 4, wherein said estimating means estimates said distance by detecting a time lapsed from the start of a movement of said armature.

7. An energization control method in an electromagnetic driving device for an engine valve in an internal combustion engine, the driving device comprising: an armature operatively connected to the engine valve; a pair of electromagnets disposed in an opposed relation to each other on opposite sides of said armature for selectively applying an electromagnetic attracting force to said armature for opening and closing the engine valve; and a pair of return springs for biasing said armature toward said electromagnets, respectively, wherein the energization control method comprises the steps of:

estimating a distance between the armature and the electromagnets during the opening and closing of the engine valve, and varying an energizing quantity for the electromagnets in accordance with said distance between the armature and the electromagnets.

8. An energization control method of claim 7, wherein said step of estimating said distance includes detecting a variation in energizing current provided to the electromagnets in accordance with a movement of the armature.

9. An energization control method of claim 7, wherein said step of estimating said distance includes detecting a time lapsed from the start of a movement of the armature.

10. An energization control method of claim 7, wherein said step of varying an energizing quantity includes decreasing the energizing quantity as the estimated distance between an energized electromagnet and the armature decreases.

* * * * *